US006925914B2

(12) United States Patent
Hsien

(10) Patent No.: US 6,925,914 B2
(45) Date of Patent: Aug. 9, 2005

(54) MAGNETIC SOCKET

(76) Inventor: Chih-Ching Hsien, 58, Ma Yuan West St., Taichung (TW)

( * ) Notice: Subject to any disclaimer, the term of this patent is extended or adjusted under 35 U.S.C. 154(b) by 62 days.

(21) Appl. No.: 10/620,853

(22) Filed: Jul. 14, 2003

(65) Prior Publication Data

US 2005/0014596 A1 Jan. 20, 2005

(51) Int. Cl.[7] ..... B25B 13/02

(52) U.S. Cl. ..... 81/125; 81/124.1

(58) Field of Search ..... 81/125, 124.1, 81/900

(56) References Cited

U.S. PATENT DOCUMENTS

| | | | | | |
|---|---|---|---|---|---|
| 1,566,760 | A | * | 12/1925 | Michel | 81/124.1 |
| 2,488,894 | A | * | 11/1949 | Barrett | 81/124.1 |
| 2,720,804 | A | * | 10/1955 | Brown | 81/125 |
| 5,249,489 | A | * | 10/1993 | Weisman | 81/124.1 |
| 2004/0093997 | A1 | * | 5/2004 | Huang | 81/125 |

* cited by examiner

*Primary Examiner*—Debra S. Meislin

(57) ABSTRACT

A magnetic socket includes a main body, an urging ring, an elastic member, and a retaining ring. Thus, the urging ring is provided with a magnetic member to provide a magnetic effect, so that the workpiece is attracted by the magnetic member without detachment, thereby facilitating the user mounting and removing the workpiece.

14 Claims, 6 Drawing Sheets

MAGNETIC SOCKET

BACKGROUND OF THE INVENTION

1. Field of the Invention

The present invention relates to a magnetic socket, and more particularly to a magnetic socket having a magnetic attraction effect, wherein the workpiece is attracted by the magnetic member without detachment, thereby facilitating the user mounting and removing the workpiece.

2. Description of the Related Art

A conventional socket wrench comprises a wrench body that may co-operate with a socket to operate and rotate a workpiece such as a bolt, a nut or the like. However, the workpiece is easily detached from the socket during rotation, thereby causing inconvenience to the user in operation. In addition, the socket cannot fix the workpiece, so that when the workpiece is unscrewed from a screw bore, the workpiece is easily detached from the socket and falls down, thereby causing inconvenience to the user.

SUMMARY OF THE INVENTION

The primary objective of the present invention is to provide a magnetic socket that is provided with a magnetic member to provide a magnetic effect, so that the workpiece is attracted by the magnetic member without detachment, thereby facilitating the user mounting and removing the workpiece.

Another objective of the present invention is to provide a magnetic socket, wherein the urging ring can be returned to the original position automatically by the restoring force of the elastic member so as to push the workpiece outward, thereby detaching the workpiece from the magnetic socket easily and conveniently.

A further objective of the present invention is to provide a magnetic socket, wherein movement of the urging ring is limited by the retaining ring.

In accordance with the present invention, there is provided a magnetic socket, comprising a main body, and an urging ring, wherein:

the main body has a first end provided with a first drive portion having an inner wall formed with a first driving recess; and the urging ring is movably mounted in the first driving recess of the first drive portion of the main body.

Further benefits and advantages of the present invention will become apparent after a careful reading of the detailed description with appropriate reference to the accompanying drawings.

DETAILED DESCRIPTION OF THE INVENTION

Figure 1:
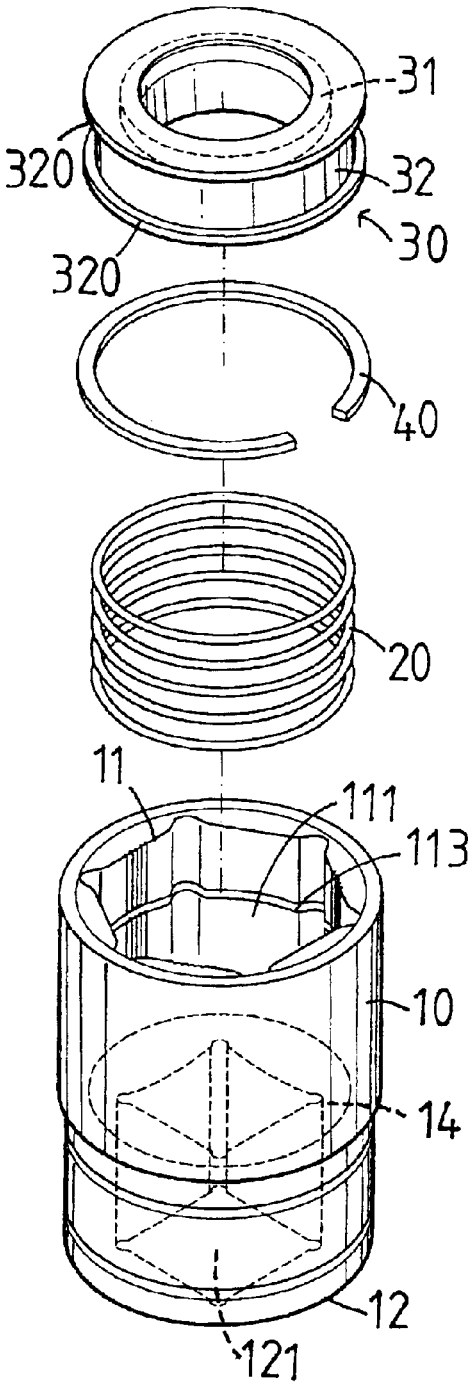
FIG. 1 is an exploded perspective view of a magnetic socket in accordance with the preferred embodiment of the present invention.
Figure 2:
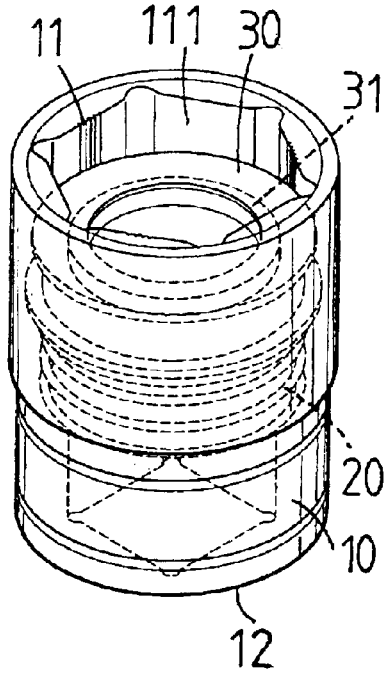
FIG. 2 is a perspective assembly view of the magnetic socket as shown in FIG. 1.
Figure 3:
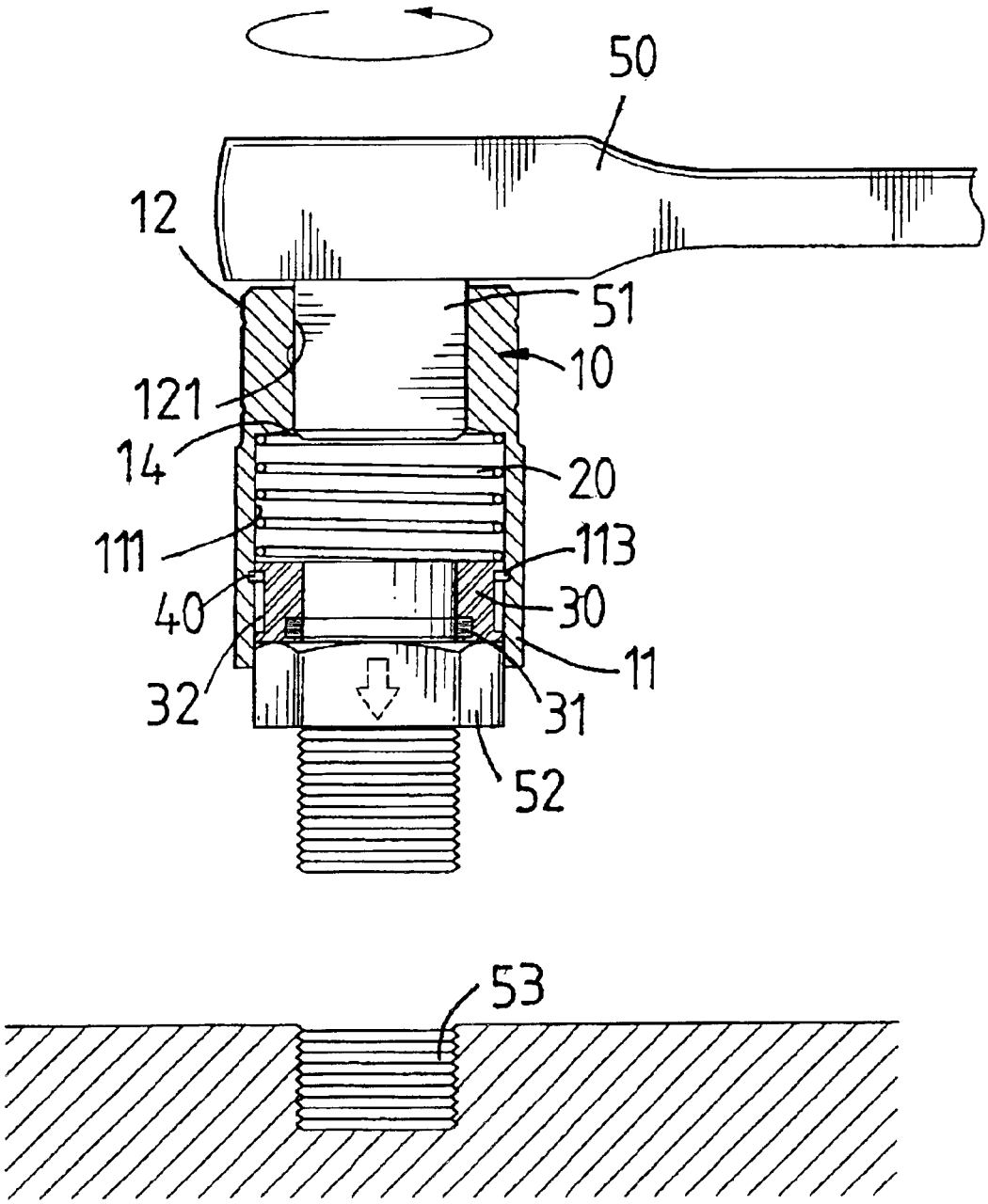
FIG. 3 is a side plan cross-sectional view of the magnetic socket as shown in FIG. 2.

Referring to the drawings and initially to FIGS. 1–3, a magnetic socket in accordance with the preferred embodiment of the present invention comprises a main body 10, an urging ring 30, an elastic member 20, and a retaining ring 40.

The main body 10 has a first end provided with a first drive portion 11 and a second end provided with a second drive portion 12. The first drive portion 11 of the main body 10 has an inner wall formed with a hexagonal first driving recess 111 and an annular locking groove 113 communicating with the first driving recess 111. The second drive portion 12 of the main body 10 has an inner wall formed with a square second driving recess 121. The main body 10 has a mediate portion formed with a resting shoulder 14 located between the first driving recess 111 of the first drive portion 11 and the second driving recess 121 of the second drive portion 12.

The urging ring 30 is movably mounted in the first driving recess 111 of the first drive portion 11 of the main body 10 and has an inner wall provided with a magnetic member 31 and an outer wall formed with an annular limiting groove 32. Preferably, the urging ring 30 has an I-shaped cross-section profile. Preferably, the magnetic member 31 is a magnetic ring.

The elastic member 20 is mounted in the first driving recess 111 of the first drive portion 11 of the main body 10 and is urged between the resting shoulder 14 of the main body 10 and the urging ring 30. Preferably, the elastic member 20 is a compression spring. In addition, the urging ring 30 has a first end urged on the elastic member 20 and a second end provided with the magnetic member 31.

The retaining ring 40 is secured in the first drive portion 11 of the main body 10 and mounted on the urging ring 30, so that the urging ring 30 is movably mounted on the retaining ring 40. The retaining ring 40 has an outer wall secured in the locking groove 113 of the first drive portion 11 of the main body 10 and an inner wall movably mounted in the limiting groove 32 of the urging ring 30. Preferably, the retaining ring 40 is a C-shaped ring. In addition, the retaining ring 40 has a height smaller than that of the limiting groove 32 of the urging ring 30, so that the retaining ring 40 is limited between two walls 320 of the limiting groove 32 of the urging ring 30.

Thus, the urging ring 30 is movably mounted in the first driving recess 111 of the first drive portion 11 of the main body 10 and movement of the urging ring 30 is limited by the retaining ring 40. In addition, the urging ring 30 has an automatically restoring function by the restoring force of the elastic member 20.

Figure 4:
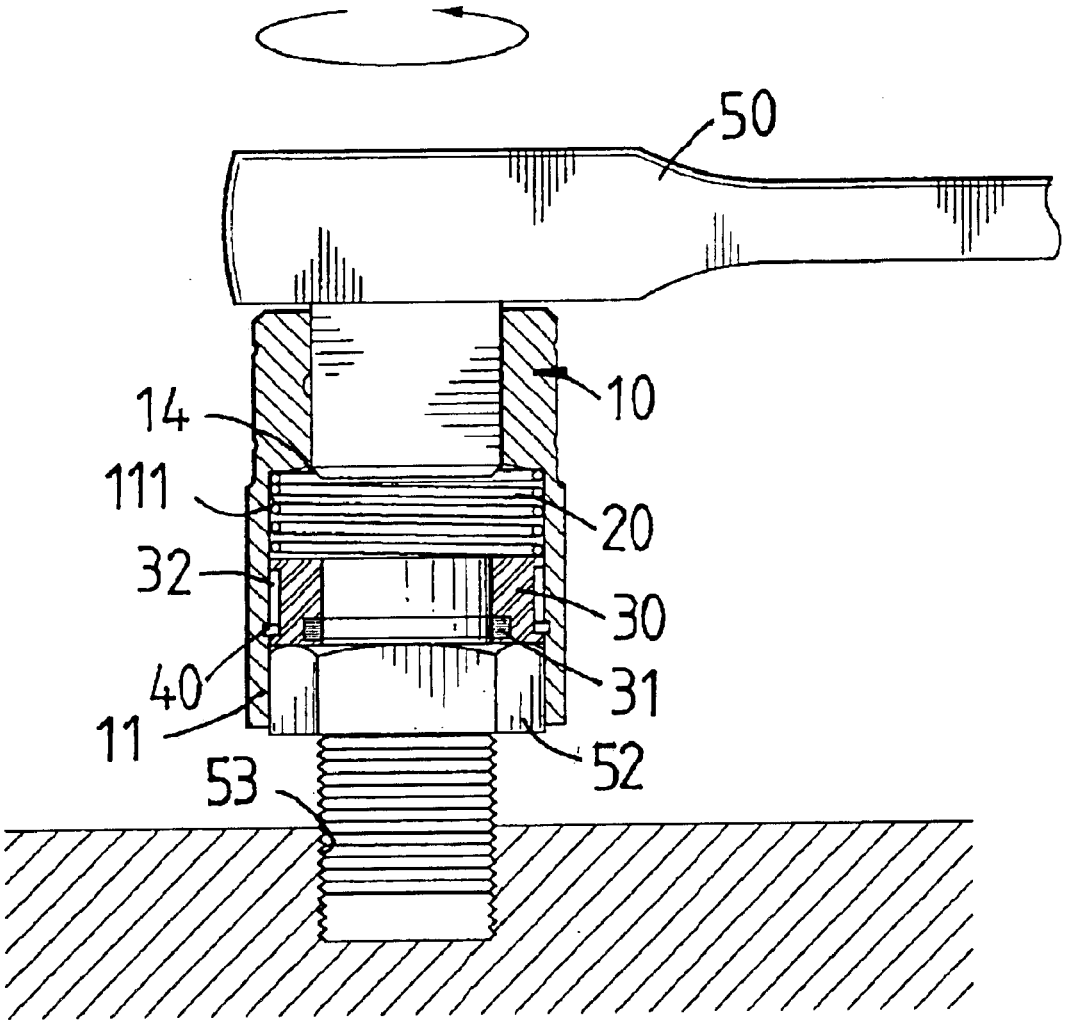
FIG. 4 is a schematic operational view of the magnetic socket as shown in FIG. 3 in use.

In operation, referring to FIGS. 3 and 4 with reference to FIGS. 1 and 2, a hand tool, such as a ratchet wrench 50, has a drive stud 51 inserted into the second driving recess 121 of the second drive portion 12 of the main body 10. Then, the first drive portion 11 of the main body 10 is mounted on a workpiece, such as a bolt 52 to screw the bolt 52 into a screw bore 53. At this time, the bolt 52 is rested on the second end of the urging ring 30 and is attracted by the magnetic member 31 without detachment. When the bolt 52 is rested on the screw bore 53, the user exerts a force on the ratchet wrench 50 to press the bolt 52 into the first driving recess 111 of the first drive portion 11 of the main body 10, so that the urging ring 30 is pressed by the bolt 52 to move from the position as shown in FIG. 3 to the position as shown in FIG. 4, and the bolt 52 is entirely inserted into the first driving recess 111 of the first drive portion 11 of the main body 10. Thus, the bolt 52 can be rotated by rotation of the ratchet wrench 50 and can be screwed into the screw bore 53 as shown in FIG. 4.

In addition, the urging ring 30 is pressed by the bolt 52, the elastic member 20 is compressed by the urging ring 30 as shown in FIG. 4, so that when the force applied on the ratchet wrench 50 is removed, the urging ring 30 pressed to move outward by the restoring force of the elastic member 20 to push the bolt 52 outward, thereby detaching the bolt 52 from the first driving recess 111 of the first drive portion 11 of the main body 10.

Figure 5:
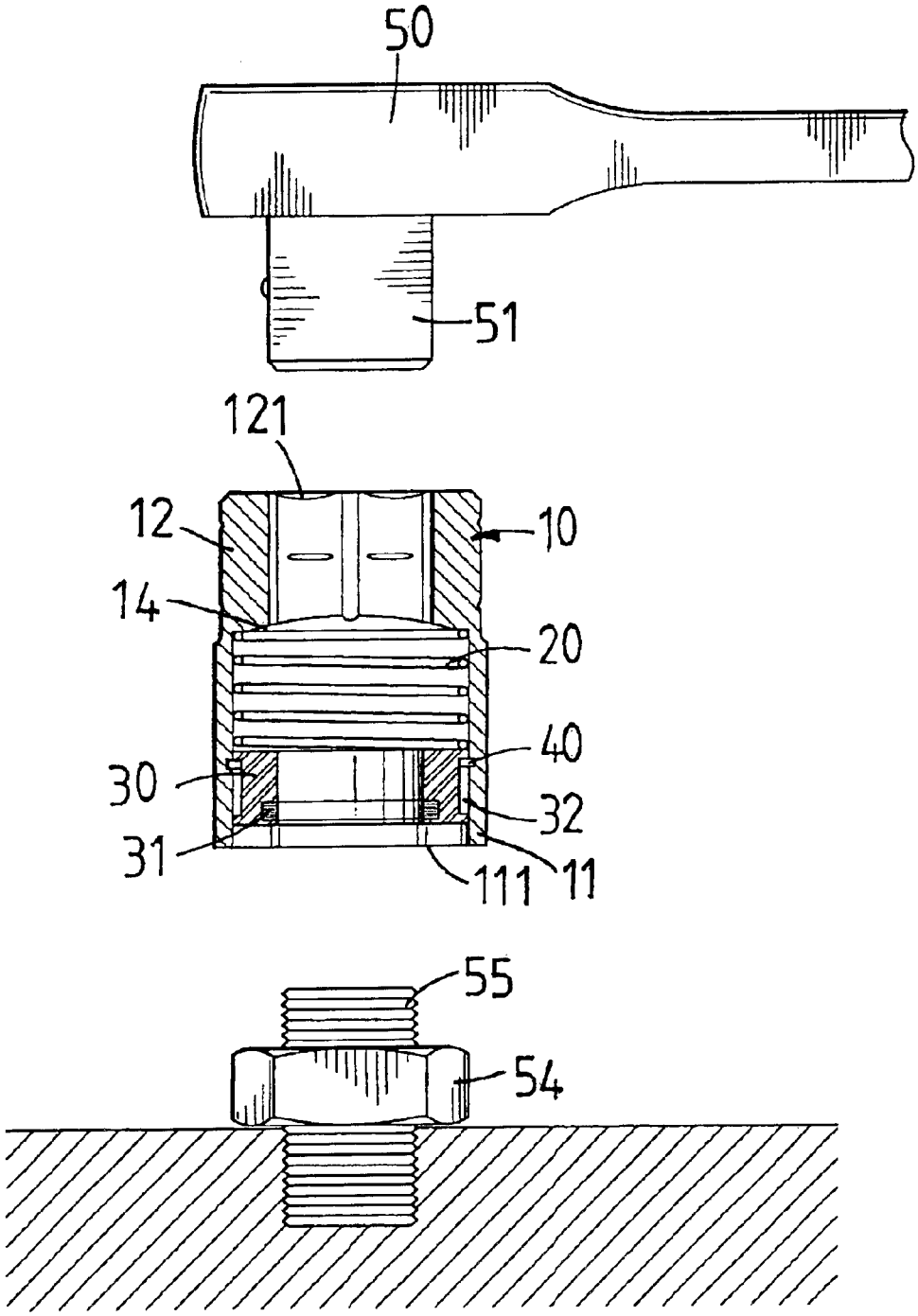
FIG. 5 is a side plan cross-sectional view of the magnetic socket as shown in FIG. 2.
Figure 6:
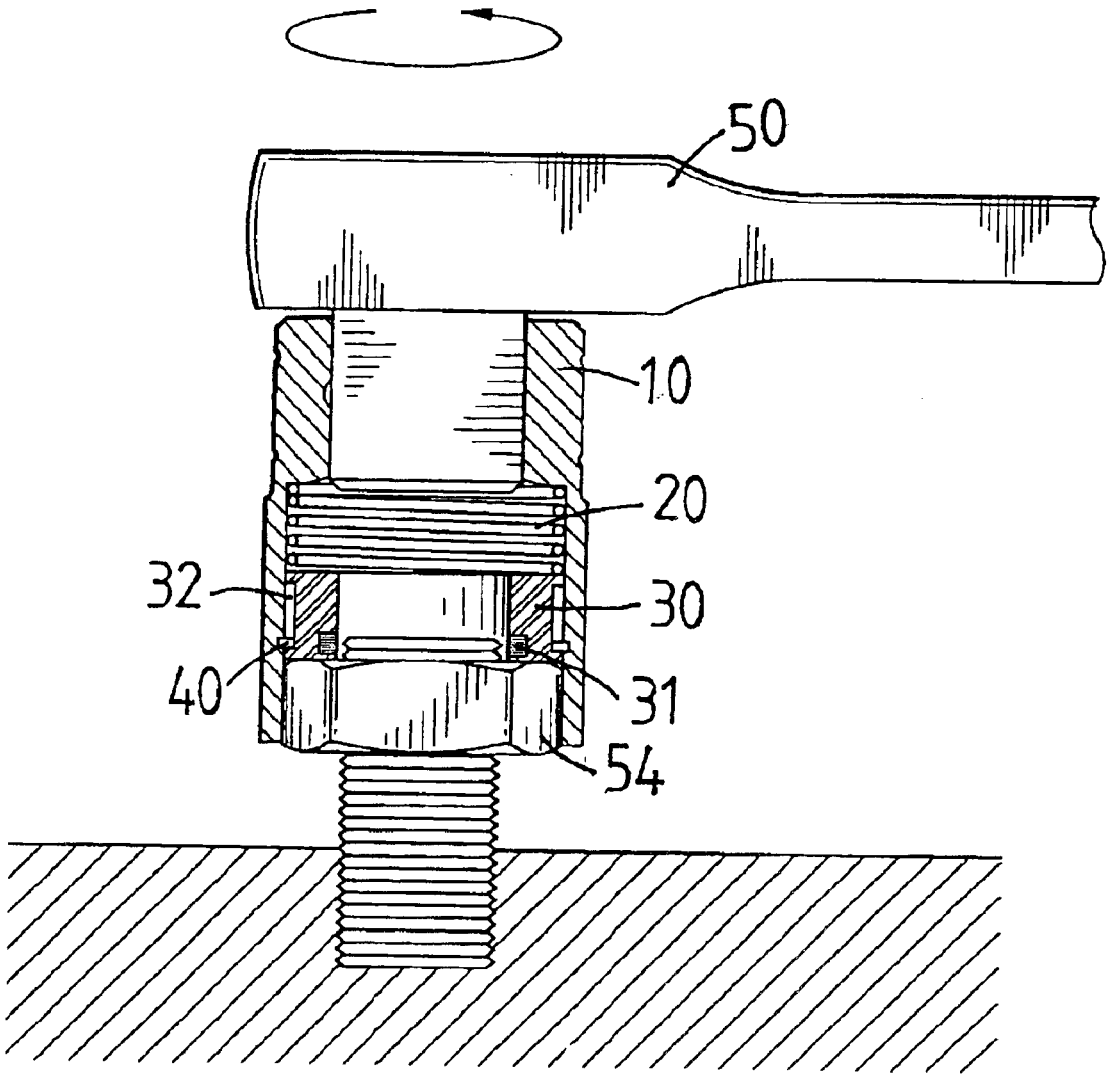
FIG. 6 is a schematic operational view of the magnetic socket as shown in FIG. 5 in use.
Figure 7:
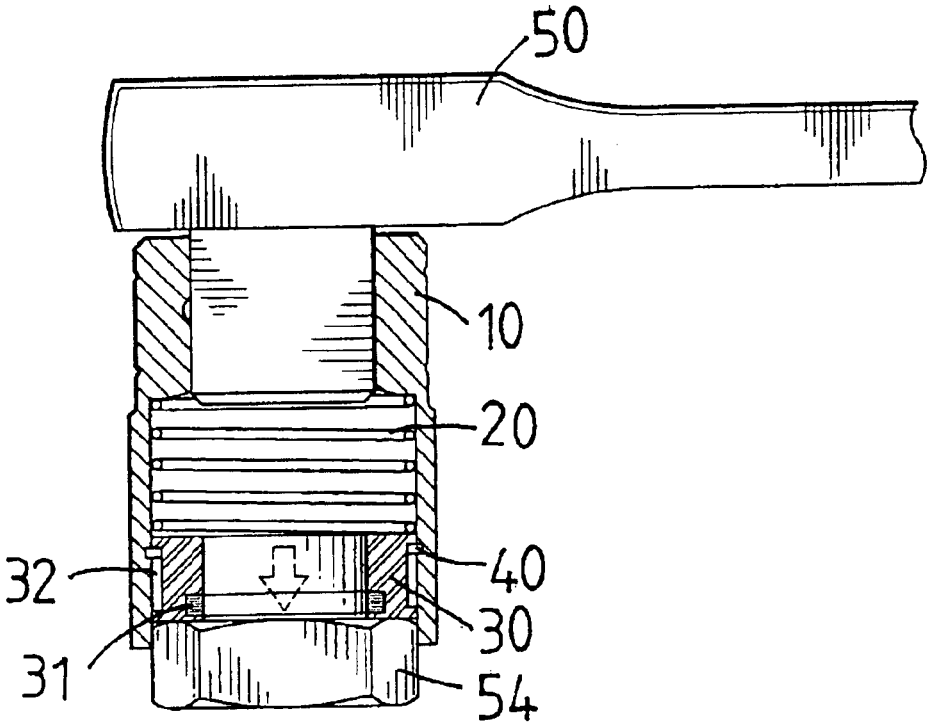
FIG. 7 is a schematic operational view of the magnetic socket as shown in FIG. 6.
Figure 7:
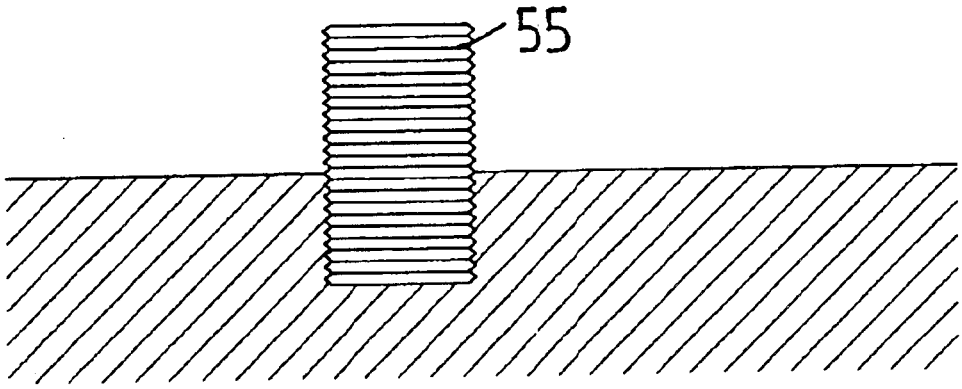

Referring to FIGS. 5–7 with reference to FIGS. 1 and 2, the magnetic socket can be used to unscrew a nut 54 from a threaded stud 55 in a similar manner. When the nut 54 is detached from the threaded stud 55, the nut 54 is attracted by the magnetic member 31 without detachment as shown in FIG. 7.

Accordingly, the magnetic socket is provided with a magnetic member to provide a magnetic effect, so that the workpiece is attracted by the magnetic member without detachment, thereby facilitating the user mounting and removing the workpiece. In addition, the urging ring 30 can be returned to the original position automatically by the restoring force of the elastic member 20 to push the workpiece outward, thereby detaching the workpiece from the magnetic socket easily and conveniently. Further, movement of the urging ring 30 is limited by the retaining ring 40.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A magnetic socket, comprising a main body, an urging ring, and a retaining ring, wherein:

the main body has a first end provided with a first drive portion having an inner wall formed with a first driving recess;

the urging ring is movably mounted in the first driving recess of the first drive portion of the main body;

the retaining ring secured in the first drive portion of the main body and mounted on the urging ring, so that the urging ring is movably mounted on the retaining ring;

the urging ring has an outer wall formed with an annular limiting groove, the inner wall of the first drive portion of the main body is formed with an annular locking groove, and the retaining ring has an outer wall secured in the locking groove of the first drive portion of the main body and an inner wall movably mounted in the limiting groove of the urging ring;

the retaining ring has a height smaller than that of the limiting groove of the urging ring, so that the retaining ring is limited between two walls of the limiting groove of the urging ring.

2. The magnetic socket in accordance with claim 1, wherein the main body has a second end provided with a second drive portion.

3. The magnetic socket in accordance with claim 2, wherein the second drive portion of the main body has an inner wall formed with a second driving recess.

4. The magnetic socket in accordance with claim 1, wherein the urging ring has an inner wall provided with a magnetic member.

5. The magnetic socket in accordance with claim 4, wherein the magnetic member is a magnetic ring.

6. The magnetic socket in accordance with claim 1, wherein the urging ring has an I-shaped cross-section profile.

7. The magnetic socket in accordance with claim 1, further comprising an elastic member mounted in the first driving recess of the first drive portion of the main body and urged on the urging ring.

8. The magnetic socket in accordance with claim 7, wherein the main body has a mediate portion formed with a resting shoulder, and the elastic member is urged between the resting shoulder of the main body and the urging ring.

9. The magnetic socket in accordance with claim 8, wherein the main body has a second end provided with a second drive portion formed with a second driving recess, and the resting shoulder is located between the first driving recess of the first drive portion and the second driving recess of the second drive portion.

10. The magnetic socket in accordance with claim 7, wherein the elastic member is a compression spring.

11. The magnetic socket in accordance with claim 7, wherein the urging ring has a first end urged on the elastic member and a second end provided with a magnetic member.

12. The magnetic socket in accordance with claim 1, wherein the locking groove communicates with the first driving recess of the first drive portion of the main body.

13. The magnetic socket in accordance with claim 1, wherein the retaining ring is a C-shaped ring.

14. The magnetic socket in accordance with claim 1, wherein movement of the urging ring is limited by the retaining ring.

* * * * *